US006578536B1

(12) United States Patent
Donohue et al.

(10) Patent No.: US 6,578,536 B1
(45) Date of Patent: Jun. 17, 2003

(54) ACTUATOR ASSEMBLY FOR ELECTROHYDRAULIC OPERATION OF CYLINDER VALVES

(75) Inventors: William Peter Donohue, Milford, MI (US); Alfred Edmund Lynn, Troy, MI (US); Gang Xu, Westlake, OH (US); Vijay Garg, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/025,579

(22) Filed: Dec. 18, 2001

(51) Int. Cl.[7] ..... F01L 1/34

(52) U.S. Cl. ..... 123/90.18; 123/90.15; 123/90.11; 123/90.12; 251/129.01; 251/129.16

(58) Field of Search ..... 123/90.18, 90.12, 123/90.1–90.55, 90.17; 137/315.03; 60/473–474; 251/129.2, 129.15, 30.01, 30.02–30.05; 239/585.3–585.5; 335/220, 251, 255

(56) References Cited

U.S. PATENT DOCUMENTS

| | | | | |
|---|---|---|---|---|
| 4,025,337 A | | 5/1977 | Woodburn et al. | |
| 4,030,919 A | | 6/1977 | Lea, III | |
| 4,640,095 A | | 2/1987 | Engel et al. | |
| 5,248,123 A | | 9/1993 | Richeson et al. | |
| 5,255,641 A | | 10/1993 | Schechter | |
| 5,275,136 A | * | 1/1994 | Schechter et al. | 123/90.12 |
| 5,410,994 A | | 5/1995 | Schechter | |
| 5,515,818 A | * | 5/1996 | Born | 123/90.11 |
| 5,531,192 A | | 7/1996 | Feucht et al. | |
| 5,572,961 A | | 11/1996 | Schechter et al. | |
| 5,577,468 A | | 11/1996 | Weber | |
| 5,829,396 A | | 11/1998 | Sturman | |
| 6,039,014 A | * | 3/2000 | Hoppie | 123/90.11 |
| 6,044,815 A | | 4/2000 | de Ojeda | |
| 6,047,735 A | | 4/2000 | Casey | |
| 6,135,073 A | | 10/2000 | Feucht et al. | |
| 6,173,684 B1 | | 1/2001 | Buehrle, II et al. | |
| 6,367,433 B2 | * | 4/2002 | Oyama et al. | 123/90.11 |

OTHER PUBLICATIONS

Kim, D., Anderson, M., Tsao, T., 1997, Dynamic Model of a Springless Electrohydraulic Valvetrain, SAE Paper #970248.

* cited by examiner

*Primary Examiner*—Thomas Denion
*Assistant Examiner*—Kyle Riddle
(74) *Attorney, Agent, or Firm*—Brinks Hofer Gilson & Lione

(57) ABSTRACT

The present invention provides an actuator assembly for operating a cylinder valve of an internal combustion engine. The actuator assembly achieves fast response times by utilizing a solenoid actuator that contains an armature element formed of a powder metal. A valve system that utilizes two of the actuator assemblies in conjunction with a cylinder valve is also provided.

23 Claims, 2 Drawing Sheets

ACTUATOR ASSEMBLY FOR ELECTROHYDRAULIC OPERATION OF CYLINDER VALVES

FIELD OF THE INVENTION

The present invention relates to electrohydraulic actuators adapted to operate cylinder valves. More particularly, the present invention relates to an electrohydraulic actuator assembly that couples a high speed solenoid switch with a stem valve, such as a poppet or cylinder valve, to control the flow of hydraulic fluid to a cylinder valve or piston mechanism.

BACKGROUND OF THE INVENTION

It is well appreciated in the art that significant benefit can be achieved through variation of the lifting and timing of intake and exhaust valves in an internal combustion engine. For example, engine performance can be enhanced by individually controlling the acceleration, velocity and travel time of the valves.

Many hydraulic systems for controlling cylinder valves have been proposed. For example, U.S. Pat. No. 5,255,641 to Schecter for a VARIABLE ENGINE VALVE CONTROL SYSTEM describes a system in which the engine valve has a piston attached to its top. Opposite surfaces of the piston are subjected to hydraulic fluid. Selective activation and deactivation of a controlling means, such as a solenoid actuator, causes the hydraulic fluid to act on the appropriate surface of the piston, which causes the valve to move.

One problem encountered in the acceptance of hydraulic control systems is the need for a very fast response time. For example, in high speed engines, the response time for engine valve activation in a full stroke typically has to be within 2 milliseconds (ms). Controllers in electrohydraulic systems have thus far not provided the desired response times. For example, solenoid actuators, which are frequently used in electrohydraulic systems, have limitations on their response time, due, at least in part to the presence of eddy currents in the metal armatage element of the valve. The term 'eddy currents' refers to the electrical currents that oppose the penetration of flux in the metal which is responsible for developing electromagnetic forces in solenoids. Eddy currents provide a natural inefficiency to electromagnetic systems, such as solenoid valves, because they limit the speed at which a magnetic field can be switched.

Powder metals provide materials that are mainly metallic, but have low conductivity which greatly reduces eddy currents. Typically, a powder metal is a compacted form comprising metal particles, such as iron particles, encased in a non-metallic material, such as an epoxy resin. These materials essentially prevent eddy currents because of the low conductivity due to the metal particles not being in contact with each other. As a result, powder metals can be used in electromagnetic systems to overcome the natural inefficiency due to eddy currents.

SUMMARY OF THE INVENTION

The present invention provides an actuator assembly that utilizes a high speed solenoid in conjunction with a stem valve, such as a poppet valve, to control the flow of hydraulic fluid to an engine intake or exhaust valve. The solenoid has an armature element formed of a powder metal, which essentially prevents eddy currents and allows the solenoid to generate the electromagnetic force to provide the desired response time. As a result, the present invention provides an electohydraulic actuator that allows for effective variable valve lift and timing control.

In one embodiment, an actuator assembly according to the present invention comprises a cylinder valve, such as a poppet valve, that is moveable between open and closed positions, a bias spring biased to keep the valve in either the open or closed position, and a solenoid actuator having an armature element formed of a powder metal and adapted to control the movement of the valve between the open and closed positions.

The present invention also provides a control assembly for operating a two stage cylinder valve. The control assembly incorporates two actuator assemblies of the present invention, one of which is connected to a high pressure source of fluid and the other of which is connected to a low pressure source of fluid. The solenoid actuators of the actuator assemblies control the position of the respective valves, which ultimately control the type of fluid that flows to the cylinder valve.

DETAILED DESCRIPTION OF THE INVENTION

The following description of preferred embodiments of the invention provides examples of the present invention. The embodiments discussed herein are merely exemplary in nature, and are not intended to limit the scope of the invention in any manner. Rather, the description of these preferred embodiments serves to enable a person of ordinary skill in the relevant art to make and use the present invention.

Figure 1:
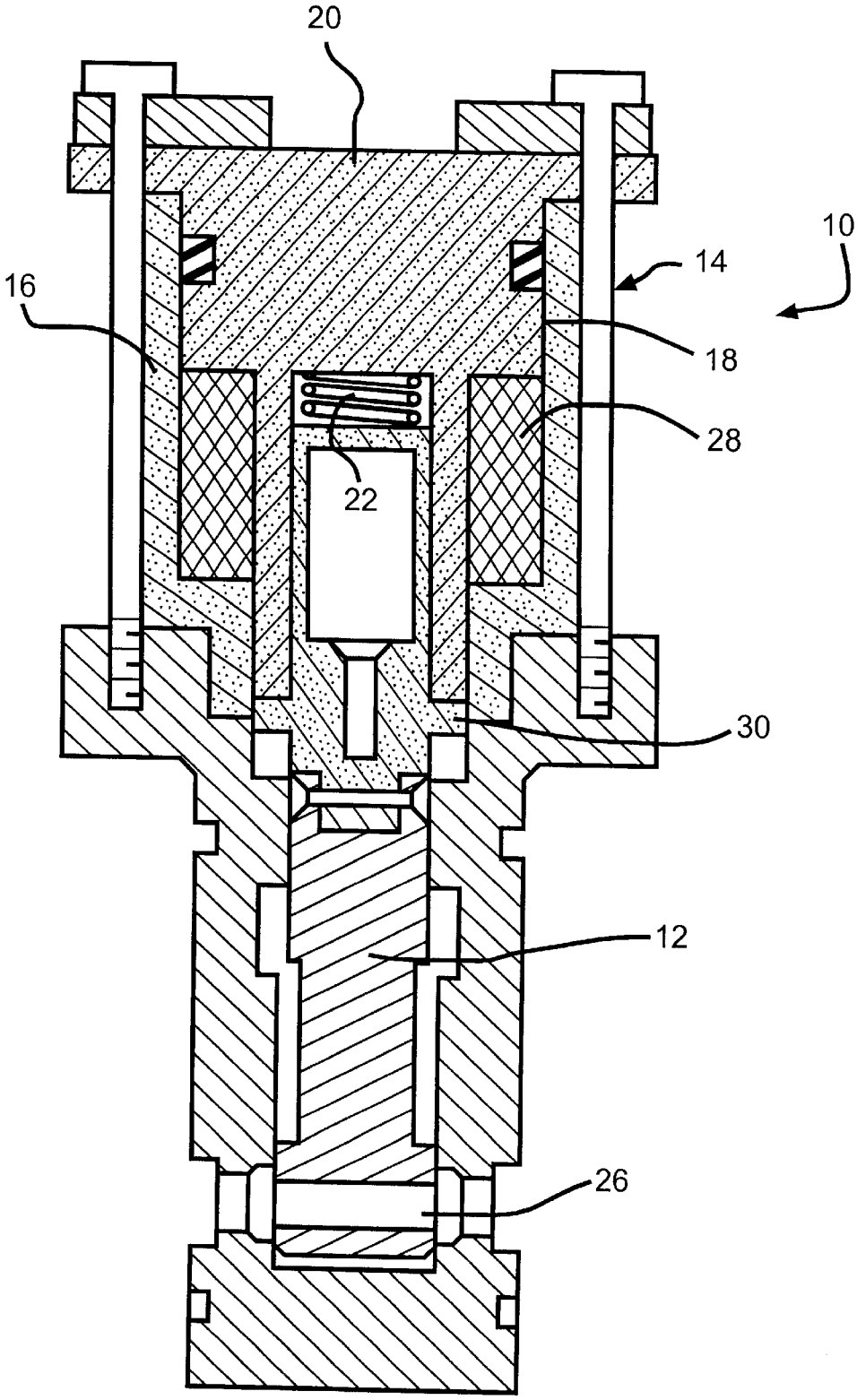
FIG. 1 is a cross-sectional view of an actuator assembly according to a preferred embodiment of the present invention.

In one aspect, the present invention provides an actuator assembly for operating a cylinder valve of an internal combustion engine. As illustrated in FIG. 1, the actuator assembly, generally indicated at reference 10, preferably includes a stem valve 12, a solenoid actuator 14, a housing 16 that defines a recess 18, a plug 20, and a bias spring 22. The stem valve 12 is moveable between two positions: an open position and a closed position. In the open position, the stem valve 12 allows flow of fluid through a channel 26 or other passageway. When in the closed position, the stem valve 12 prevents this flow.

The stem valve 12 can be any suitable valve type known to those skilled in the art. The stem valve 12 need only be able to regulate the flow of fluid, as described above, and be able to be operably connected to the solenoid actuator 14, as described below. Examples of suitable valves for use as the stem valve 12 include poppet valves and spool-type valves.

The bias spring 22 can be a conventional bias spring employed by those skilled in the art to preferentially position a valve in one of its available positions. As used in the actuator assembly of the present invention, the bias spring can be biased to keep the stem valve 12 in either the open or closed position.

The solenoid actuator 14 operates the movement of the stem valve 12 between the open and closed positions. Except as described below, the solenoid actuator 14 is similar to a conventional solenoid actuator in architecture but differs considerably in performance due to the application of powder metal technology. Thus, the solenoid actuator 14 includes a solenoid coil 28, an armature element 30, a housing 16 and the plug 20. The coil 28 is wrapped inside the cylindrical portion of plug 20 in the conventional manner such that the armature element 30 can move into and out of the recess 18 when an electrical current is passed through the coil 28. The plug 20 is positioned in the recess to stop movement of the armature element 30.

The armature element 30 is adapted to control movement of the stem valve 12 between the open and closed positions. This links the movement of the stem valve 12 to the movement of the armature element 30, which is controlled by the solenoid coil 28. As illustrated in FIG. 1, the armature element 30 and stem valve 12 are preferably directly connected with each other, and any suitable means for attaching these elements can be used. Examples of suitable attachment means include adhesive, rivets and other fasteners, and compressive forces. Alternatively, the armature element 30 and stem valve 12 can be integrally formed. Also alternately, the armature element 30 can open a passageway to permit hydraulic fluid to enter and exit the area between armature element 30 and valve 12, causing valve 12 to move by the difference of pressure between the ends of valve 12.

As indicated above, the actuator assembly 10 of the present invention provides a high speed actuator suitable for use in electrohydraulic valve systems. The assembly achieves very fast actuation speeds by the use of powder metal in one or more components of the assembly.

Powder metal, as a composition, is known to those skilled in the art. Typical powder metal composites comprise metal particles, such as iron, encased in a non-metallic material. The powder metal can be formed into various shapes by several processes, such as that disclosed in U.S. Pat. No. 4,030,919 to Lea for A CONTINUOUS METHOD OF AND APPARATUS FOR MAKING BARS FROM POWDERED METAL.

The armature element 30 of the actuator assembly 10 is formed of a powder metal. Preferably, other elements of the assembly 10 are also formed of a powder metal. For example, the inventors have discovered that the housing 16 and plug 20 are advantageously formed of powder metal.

Any suitable powder metal can be used in forming the parts of the assembly 10. A preferred powder metal comprises a plurality of iron particles coated with an inorganic material. Also preferable, the inorganic material comprises an inorganic oxide, such as a silicon oxide, which acts as an electrical insulator. Such a powder metal is commercially available from Mii Technologies, LLC, of West Lebanon, N.H.

Figure 2:
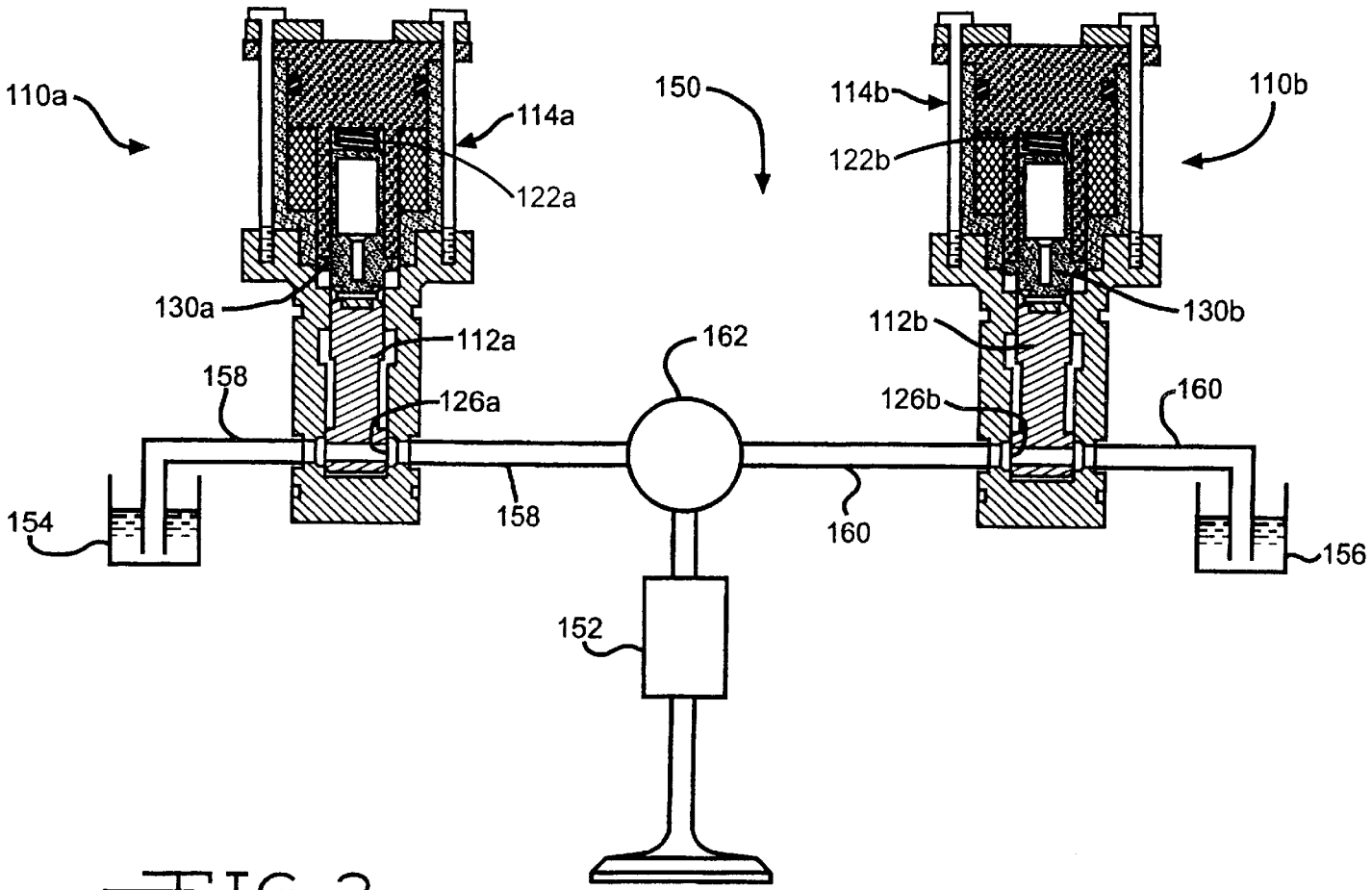
FIG. 2 is a partial cross-sectional view of a hydraulically activated valve system according to a preferred embodiment of the present invention.

FIG. 2 illustrates a control assembly 150 for operating a cylinder valve 152 of an internal combustion engine. The assembly 150 incorporates two actuator assemblies 110 in accordance with the present invention. Accordingly, similar reference numbers in FIG. 2 refer to similar features and/or components illustrated in FIG. 1.

As illustrated in FIG. 2, the control assembly 150 includes a high pressure source of fluid 154, low pressure source of fluid 156, a high pressure actuator assembly 110*a*, a low pressure actuator assembly 110*b*, a high pressure fluid line 158, and a low pressure fluid line 160.

The high 110*a* and low 110*b* pressure control assembly each include a stem valve 112*a*, 112*b* and a solenoid actuator 114*a*, 114*b*. The solenoid actuators 114*a*, 114*b* each include an armature element 130*a*, 130*b*. At least one of the armature elements 130*a*, 130*b* is formed of a powder metal. Preferably, the armature element 130*a* of the solenoid actuator 114*a* of the high pressure control assembly 110*a* is formed of powder metal as described above. Particularly preferable, the armature element 130*b* of the solenoid actuator 114*b* of the low pressure control assembly 110*b* is also formed of a powder metal as described above.

The high pressure fluid line 158 communicates with the high pressure source of fluid 154, the high pressure stem valve 112*a*, and the cylinder valve 152 of the engine by way of a valve 162. Likewise, the low pressure fluid line 160 communicates with the low pressure source of fluid 156, the low pressure stem valve 112*b*, and the cylinder valve 152 by way of a valve 162. Thus, the high pressure control assembly 110*a* is adapted to allow high pressure fluid flow to the cylinder valve 152 by way of actuating the armature 130*a* to open the stem valve 112*a*, while the low pressure control assembly 110*b* is adapted to allow low pressure fluid to flow to the cylinder valve 152 by way of actuating the armature 130*b* to open the stem valve 112*b*. The control assembly 150 thus opens and closes the cylinder valve 152 by selectively activating and deactivating the actuator assemblies 110*a*, 110*b*, which controls the type of fluid exposed to the cylinder valve 152.

Bias springs 122*a*, 122*b* are biased to place the stem valves 112*a*, 112*b* in opposite positions. Preferably, for example, the bias spring 122*a* in the high pressure actuator assembly 110*a* is biased to place stem valve 112*a* in a closed position, while bias spring 122*b* in the low pressure actuator assembly 110*b* is biased to place stem valve 112*b* in an open position.

The references cited in this disclosure, except to the extent they contradict any statements or definitions made herein, are incorporated by reference in their entirety.

The foregoing disclosure includes the best mode devised by the inventors for practicing the invention. It is apparent, however, that several variations in accordance with the present invention may be conceivable to one of ordinary skill in the relevant art. Inasmuch as the foregoing disclosure is intended to enable such person to practice the instant invention, it should not be construed to be limited thereby, but should be construed to include such aforementioned variations. As such, the present invention should be limited only by the spirit and scope of the following claims.

We claim:

1. A hydraulically operated valve system for an internal combustion engine having a cylinder bore, said system comprising:

a high pressure source of fluid;

a low pressure source of fluid;

a first control valve assembly comprising a first stem valve moveable between open and closed positions and a first solenoid actuator having an armature element, the first control valve assembly being operably connected to the high pressure source of fluid;

a second control valve assembly comprising a second stem valve moveable between open and closed positions and a second solenoid actuator having an armature element, the second control valve assembly being operably connected to the low pressure source of fluid;

a cylinder valve adapted to selectively provide fluid access to said cylinder bore and being operably connected to the first and second control valve assemblies such that the cylinder valve moves into an open position when the first stem valve is in the open position and the second stem valve is in the closed position;

the armature element of the first control valve being formed of a powder metal comprising a plurality of iron particles coated with an inorganic material.

2. The hydraulically operated valve system of claim 1, wherein a first bias spring is positioned to bias the first stem valve in the closed position.

3. The hydraulically operated valve system of claim 2, wherein a second bias spring is positioned to bias the second stem valve in the open position.

4. The hydraulically operated valve system of claim 1, wherein the armature element of the second solenoid actuator is formed of a powder metal.

5. The hydraulically operated valve system of claim 1, wherein the inorganic material is an inorganic oxide material.

6. The hydraulically operated valve system of claim 5, wherein the inorganic material is silicon oxide.

7. The hydraulically operated valve system of claim 1, wherein the first solenoid actuator has a response time of equal to or less than about 1 ms.

8. The hydraulically operated valve system of claim 1, said first solenoid actuator having a housing defining a recess that receives the armature element, the housing being formed of a powder metal.

9. The hydraulically operated valve system of claim 8 having a plug positioned in said recess to stop movement of said armature element, the plug being formed of a powder metal.

10. The hydraulically operated valve system of claim 1, said second solenoid actuator further comprising a housing defining a recess that receives said armature element, and a plug positioned in said recess to stop movement of said armature element, the housing and the plug being formed of a powder metal.

11. A control assembly for operating a cylinder valve on an internal combustion engine, said control assembly comprising:

a high pressure source of fluid;

a low pressure source of fluid;

a high pressure valve comprising a first stem valve and first bias spring;

a low pressure valve comprising a second stem valve and a second bias spring;

a high pressure fluid line communicating with the high pressure source of fluid, the high pressure valve, and said cylinder valve;

a low pressure fluid line communicating with the low pressure source of fluid, the low pressure valve, and said cylinder valve;

a first solenoid actuator adapted to move the first stem valve between open and closed positions, and having a first armature element formed of a powder metal; and a second solenoid actuator having a second armature element adapted to move the second stem valve between open and closed positions.

12. The control assembly of claim 11, wherein the first bias spring is positioned to bias the first stem valve in the closed position.

13. The control assembly of claim 12, wherein the second bias spring is positioned to bias the second stem valve in the open position.

14. The control assembly of claim 11, wherein the second armature element is formed of a powder metal.

15. The control assembly of claim 11, wherein the powder metal comprises a plurality of iron particles coated with an inorganic material.

16. The control assembly of claim 15, wherein the inorganic material is an inorganic oxide material.

17. The control assembly of claim 16, wherein the inorganic material is silicon oxide.

18. An actuator assembly for operating a cylinder valve of an internal combustion engine, said assembly comprising:

a stem valve moveable between open and closed positions;

a solenoid actuator having a housing defining a recess, an armature element and a plug, the recess receiving the armature element, the armature element adapted to control movement of the stem valve between the open and closed positions, the plug positioned in the recess to stop movement of the armature element; and the armature element, housing and plug being formed of a powder metal.

19. The actuator assembly of claim 18, further comprising a bias spring that is positioned to bias the stem valve in the closed position.

20. That actuator assembly of claim 18, further comprising a bias spring that is positioned to bias the stem valve in the open position.

21. The actuator assembly of claim 18, wherein the powder metal comprises a plurality of iron particles coated with an inorganic material.

22. The actuator assembly of claim 21, wherein the inorganic material is an inorganic oxide material.

23. The actuator assembly of claim 22, wherein the inorganic material is silicon oxide.

* * * * *